United States Patent [19]

Grant, Jr.

[11] Patent Number: 4,913,576

[45] Date of Patent: Apr. 3, 1990

[54] MOLDING BRACKET FOR COVERING THE END OF A PANEL SUBJECT TO THERMAL EXPANSION

[75] Inventor: Bowie L. Grant, Jr., Naperville, Ill.

[73] Assignee: Dyrotech Industries, Inc., Joliet, Ill.

[21] Appl. No.: 367,328

[22] Filed: Jun. 16, 1989

[51] Int. Cl.[4] ..... A47G 27/04; E04G 19/02

[52] U.S. Cl. ..... 403/13; 403/300; 403/405.1; 16/7; 16/16; 52/470; 52/573; 52/716

[58] Field of Search ..... 52/285, 470, 573, 716, 52/772, 788; 403/300, 305, 292, 13, 28, DIG. 10, 405.1; 16/7, 16

[56] References Cited

U.S. PATENT DOCUMENTS

| | | | |
|---|---|---|---|
| 545,237 | 8/1895 | Lassam | 52/470 |
| 1,774,121 | 8/1930 | Wilson | 52/468 |
| 2,073,278 | 3/1937 | Hohl | 16/16 X |
| 2,258,314 | 10/1941 | Bonnell | 16/16 X |
| 2,796,624 | 6/1957 | Speer | 52/573 |
| 3,162,906 | 12/1964 | Dudley | 52/470 |
| 3,445,972 | 8/1966 | Carr | 52/98 |
| 4,485,600 | 12/1984 | Olson | 52/62 |
| 4,753,056 | 6/1988 | Pacca | 52/788 X |

FOREIGN PATENT DOCUMENTS

| | | | |
|---|---|---|---|
| 28554 | of 1906 | United Kingdom | 52/470 |
| 857025 | 12/1960 | United Kingdom | 16/7 |
| 1026077 | 4/1966 | United Kingdom | 16/16 |
| 1375276 | 11/1974 | United Kingdom | 16/7 |

*Primary Examiner*—Randolph A. Reese
*Assistant Examiner*—Franco Deliguori
*Attorney, Agent, or Firm*—Fitzpatrick, Cella, Harper & Scinto

[57] ABSTRACT

A molding bracket for covering a seam formed by two end-to-end panels, subject to thermal expansion and contraction. The bracket comprises a longitudinally extending division bar, two pairs of flanges extending in opposite directions from the division bar to define opposite channels for receiving the ends of the panels between the pair of channels. Stop bead means on the inside of at least one of the flanges of each pair extend into the channels for engaging the panels inserted therein, thus allowing the panels to be inserted far enough into the channels to cover the ends of the panels and while allowing the panels to move past the stop bead means upon thermal expansion of the panels to prevent buckling thereof.

15 Claims, 2 Drawing Sheets

MOLDING BRACKET FOR COVERING THE END OF A PANEL SUBJECT TO THERMAL EXPANSION

BACKGROUND OF THE INVENTION

1. Field of the Invention

The present invention relates to a bracket and, more particularly, to a molding bracket for covering the end of a panel or the end-to-end seam between two panels subject to thermal expansion.

2. Description of the Prior Art

Brackets are placed over the end of a panel attached to a wall or ceiling to provide a decorative cover for the end of the panel or the end-to-end seam between two such panels. However, molding brackets for this purpose typically have not allowed for thermal expansion of the panel or panels. Accordingly, the panel can be restrained by the bracket as the panel expands, and the panel can buckle.

As illustrated in FIG. 1, a typical prior art molding bracket accepts an end of a panel 1 into a channel 2 provided by the molding bracket. Another channel 3, opposed to the channel 2, accepts an end of a second panel 4. However, unless sufficient space is left between the division bar 5 of the molding bracket and the facing ends of the panels 1 and 4, the panels will be restrained and will tend to buckle, as shown in dotted lines in FIG. 1, as they undergo thermal expansion.

Theoretically, this problem can be overcome by inserting the panels into the channels 2 and 3 only far enough so that the ends of the panels are covered, while leaving enough space between the division bar 5 and the ends of the panels to allow for thermal expansion. This solution is impractical for several reasons.

First, it requires an installer very carefully to measure the panels and secure them to the wall 6 at precisely determined locations that will provide a gap between the ends of the panel in their mounted positions. This is a very time-consuming, and thus costly, procedure. Even then, for relatively large panels the slightest error in mounting can result in a gap between the panels that is too large and thus the panels ends can be exposed if the panels undergo thermal contraction.

Second, if the panels are secured to the wall using a fastener such as that disclosed in co-pending U.S. patent application Ser. No. 07/304,485, assigned to the assignee of the present invention, this solution is even more impracticable. That fastener has a neck portion with a cross-section smaller than the cross-section of a hole in the panel through which the fastener passes, thus allowing for thermal expansion or contraction of the panel. Thus, the precise location of the panel in its mounted position is not positively determined when this fastener is used. Accordingly, it becomes even more difficult for an installer to properly locate the panels 1 and 4 relative to each other and to the division bar 5 to account for the movement of the ends of the panels as the panels expand and contract with temperature changes.

The prior art has attempted to address this problem with brackets such as those shown in U.S. Pat. Nos. 1,774,121, 3,445,972 and 4,485,600. However, all of these patents use resilient or deformable members attached to the division bar of a bracket such as that shown in FIG. 1. For example, U.S. Pat. No. 3,445,972 uses a deformable, depending tongue that extends from the division bar partway across each channel of the bracket. The tongue is meant to intercept a panel inserted into the channel to automatically limit the depth to which the panel extends into the channel. Then, if the panel expands after mounting, the tongue is meant to deform or break to allow such expansion and prevent buckling of the panel.

These brackets, however, also represent an incomplete solution to the problem since all of them rely on structure that actually bears against the end surface of the panel. Accordingly, they are not as useful for thin panels, such as fiberglass reinforced panels that are typically only about 1/16" thick. Such a panel inserted into the channel of a molding bracket like those discussed above may completely miss the structure intended to intercept it, and thus defeat the purpose of having such structure.

SUMMARY OF THE INVENTION

It is an object of the present invention to provide a molding bracket which overcomes these disadvantages.

In accordance with an aspect of the present invention, a molding bracket for covering an end of a panel, subject to thermal expansion and contraction comprises a division bar and at least one pair of flanges extending from the division bar to define a channel between the flanges for receiving the end of the panel. Stop bead means disposed on the inside of at least one of the flanges at a location spaced from the division bar extend transversely of the channel for a portion of the width thereof for engaging the panel inserted into the channel to position the end of the panel a predetermined distance from the division bar. Thus, the panel can be inserted far enough into the channel to cover the end of the panel and allow the panel to move past the stop bead means deeper into the channel upon thermal expansion of the panel to prevent buckling of the panel.

In accordance with another aspect of the invention, two pairs of flanges extend in opposite directions from the division bar to define opposed channels for receiving the ends of panels between said respective pair of channels. Both channels include stop bead means.

BRIEF DESCRIPTION OF THE DRAWINGS

The present invention can be understood by reference to the detailed description of preferred embodiments set forth below taken with the drawings, in which.

DETAILED DESCRIPTION OF PREFERRED EMBODIMENTS

Figure 1:
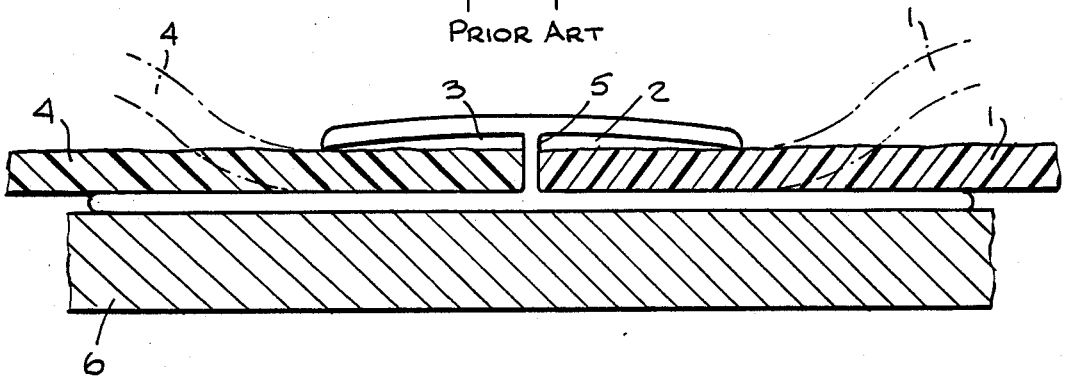
Fig. 1. PRIOR ART
FIG. 1 shows a prior art molding bracket.
Figure 2:
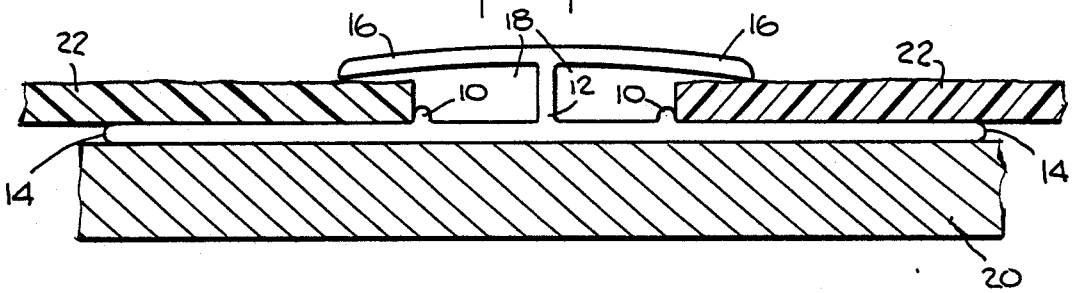
FIG. 2 is a cross-sectional view of a molding bracket in accordance with one embodiment of the present invention, with panels inserted into the channels of the bracket.

FIG. 2 shows a preferred embodiment of a molding bracket in accordance with the present invention. The molding bracket includes a longitudinally extending division bar 12. Two pairs of flanges extend from the division bar 12. Each pair of flanges includes an inner flange 14 and an outer flange 16, which define a pair of channels 18, each having an opening for receiving the end of a panel 22 mounted to a wall 20. Each side of the division bar 12 forms the bottom of one of the channels.

A bead 10 spaced from the division bar 12 is provided on the inside of each channel on the inner flange 14 and extends transversely of the corresponding channel for at least a portion of the width thereof for engaging the panels 22 inserted into the channels 18. These beads 10 position the ends of the panels a predetermined distance from the division bar 12, thereby allowing the panels 22 to be inserted far enough into the channels to cover the ends of the panels and allowing the panels to move past the beads 10 and deeper into the channels upon thermal expansion of the panels to prevent buckling thereof.

Figure 3:
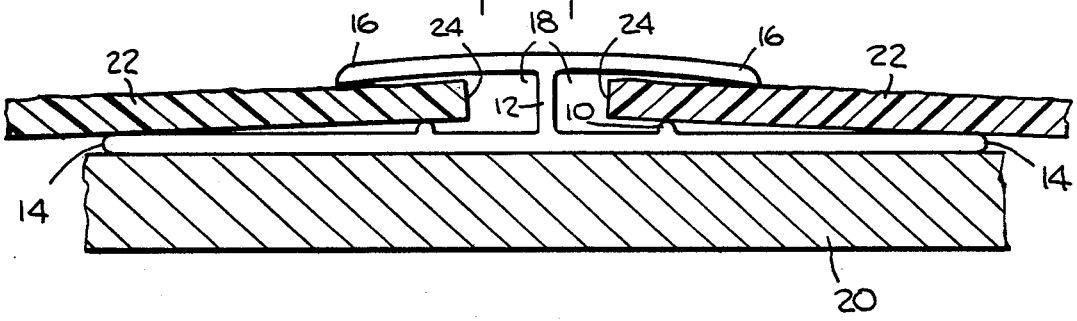
FIG. 3 shows the molding bracket of FIG. 2 after the panels have undergone thermal expansion.

FIG. 3 is a view of the molding bracket of FIG. 2 after the panels 22 have expanded. As shown, the ends 24 of the panels are forced over the beads 10 and toward the division bar 12 thus allowing the panels to expand free from any restraints. Thus, buckling of the panel is prevented. If the panel contracts, it simply returns to its original position as shown in FIG. 2. Of course, care must be taken to allow sufficient space between the beads 10 and the division bar 12 so that there is sufficient room for the panel to fully expand. If the beads 10 are set too close to the division bar 12, as the panel expands and is forced over the beads, it will be restrained by the division bar 12 and the aforementioned buckling will occur. In addition, the distance between the beads 10 and the openings of the channels 18 should permit the panel to contract without withdrawal of the panel ends from the channel.

It will be appreciated by those skilled in the art that the use of stop bead means, such as the beads 10, located on the flanges at a distance from the division bar ensures more positive engagement with the panel ends than the prior art deformable members mounted at the division bar. In addition, the slight curvature of the outer flanges allows the panels easily to "ride" over the stop beads means. If the opposing outer flange 16 is flexible, panel expansion is further faciliated.

Figure 4:
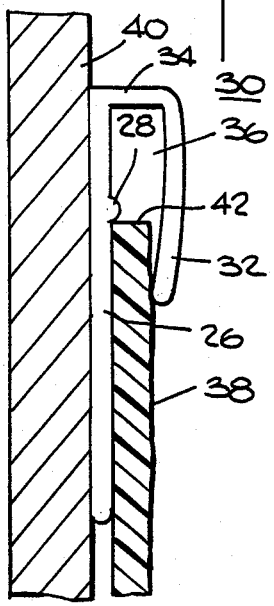
FIGS. 4 to 7 illustrate different molding brackets in accordance with alternate embodiments of the present invention.

FIG. 4 shows another embodiment of a molding bracket 30 in accordance with the present invention. The molding bracket 30 includes a longitudinally extending division bar 34. A pair of flanges extending from the division bar include an inner flange 26 and an outer flange 32 which define a channel 36 having an opening for receiving the end of a panel 38 mounted to the wall 40. The division bar 34 forms the bottom of the channel. A bead 28 is spaced from the division bar 34 on the inside of the inner flange 26 and extends transversely of the channel 36 for a portion of the width thereof to engage the panel 38 inserted into the channel 36 to position the end 42 of the panel 38 a predetermined distance from the division bar 34.

In this embodiment, the flanges are closer together at the opening to the channel 36 than at the division bar 34. This further ensures that there is sufficient space between the bead 28 and the outer flange 32 for the panel to be forced over the bead when expansion occurs. The outer flange 32 may also be flexible so that it will flex and the channel opening will expand when the panel is forced over the bead.

It will also be noted that the inner flanges 14 (FIG. 2) and 26 (FIG. 4) are normal to the division bars 12 and 34 and present a smooth flat surface which can be placed against the wall. The beads 10 and 28 extend longitudinally of the flange and parallel to the division bar 34.

Figure 5:
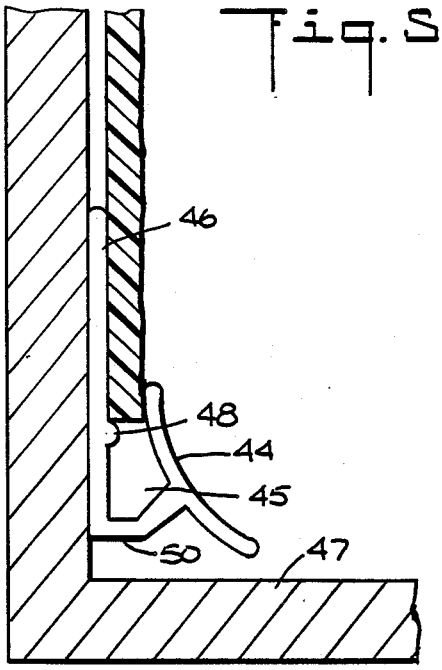

As shown in FIG. 5, the molding bracket may be shaped such that the division bar 50 is bent toward the inner flange 46 and terminates at an outer flange 44 that forms a T with the division bar 50. Since the outer flange 44 extends past the division bar 50 in an opposite direction to the channel 45, this configuration provides a decorative cover for an inside corner of the wall 47.

Figure 6:
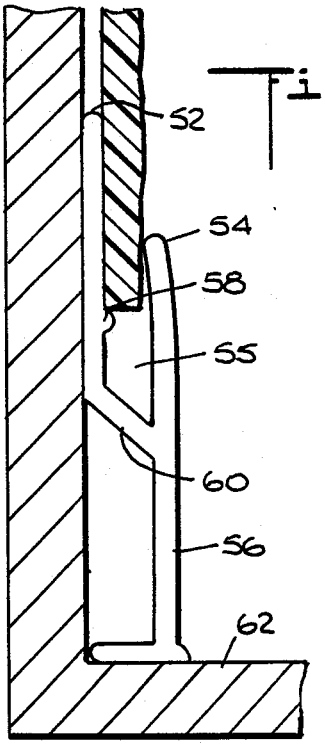

FIG. 6 shows still a further embodiment of the present invention, wherein the outer flange 54 extends past the division bar 60 in a direction opposite the channel 55 to form a spacer 56 to space the channel 55 a predetermined distance from an inside corner of the wall 62. The bead 58 is on the inner flange 52, as in previous embodiments.

Figure 7:
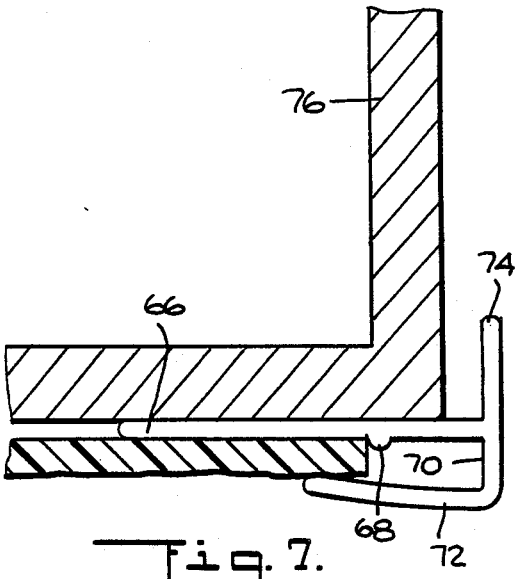

The embodiment shown in FIG. 7 is a molding bracket wherein the inner flange 66 extends from a position intermediate the ends of the division bar 70 so that the division bar extends past the channel to form a fence 74 which may be used to either rest against an outside corner of wall 76 to cover the edge of the wall or may cover an end of a panel placed along the wall 76. The bend 68 is on the inner flange 66, as in previous embodiments.

The molding bracket of the present invention may be made of polyvinyl chloride or any other similar material which may be easily molded or extruded. The parts of the molding brackets shown in FIGS. 2 to 7 are integral.

The present invention thus provides a molding bracket which is both decorative and allows for the thermal expansion of a panel inserted into the bracket. The molding bracket can be used for thin fiberglass reinforced panels which, prior to this invention, were difficult to install properly using prior art moldings.

Of course, it will be appreciated that the invention may take forms other than those specifically described. For example, the molding bracket may be in forms other than as described or shown.

Although the invention has been described above by referring to preferred embodiments, it will be clear to those skilled in the art that changes and modifications other than those specifically pointed out may be made to the disclosed embodiments without departing from the spirit and scope of the present invention, which is to be determined by reference to the appended claims.

What is claimed is:

1. A molding bracket for covering the end of a panel subject to thermal expansion and contraction, the bracket comprising:

a division bar;

at least one pair of flanges extending from said division bar to define a channel having an opening between said flanges for receiving the end of the panel; and stop bead means disposed on the inside of at least one of said flanges at a location spaced from said division bar and extending transversely of said channel for a portion of the width thereof for engaging the end of the panel inserted into said channel to position the end of the panel a predetermined distance from said division bar, and with the height of said stop bead means being proportioned relative to the height of said channel such that said stop bead means allows the panel to be inserted far enough into said channel to cover the end of the panel and allows the panel to move past the stop bead means and deeper into said channel upon thermal expansion of the panel to prevent buckling thereof.

2. A molding bracket according to claim 1, wherein said flanges are closer together at said opening to said channel than at said division bar.

3. A molding bracket according to claim 1, wherein at least one said flange is flexible.

4. A molding bracket according to claim 1, wherein at least one of said flanges is substantially normal to said division bar and has said stop bead means thereon.

5. A molding bracket according to claim 4, wherein said stop bead means comprises a bead extending longitudinally of said flange and parallel to said division bar.

6. A molding bracket according to claim 1, further comprising a second pair of flanges extending from said division bar to form a second channel opposed to said first-mentioned channel, wherein at least one of said flanges of said second pair has stop bead means thereon.

7. A molding bracket according to claim 1, wherein said division bar is bent toward said one of said flanges and terminates at said other flange.

8. A molding bracket according to claim 7, wherein said other flange extends past said division bar in an opposite direction to said channel.

9. A molding bracket according to claim 1, wherein one of said flanges extends past said division bar in a direction opposite said channel for providing a spacer.

10. A molding bracket according to claim 1, wherein one of said flanges extends from a position intermediate the ends of said division bar.

11. A molding bracket for covering a seam formed by two end-to-end panels subject to thermal expansion and contraction, the bracket comprising:

a division bar;

two pairs of flanges, each extending in opposite directions from said division bar to define opposed channels having openings for receiving the ends of the respective panels; and stop bead means disposed on the inside of at least one of said flanges of each said respective pair at a location spaced from said division bar and extending transversely of said respective channel for at least a portion of the width thereof for engaging the ends of the panels inserted into said channels to position the ends of the panels a predetermined distance from said division bar, and with the height of said stop bead means being proportioned relative to the height of its respective channel such that said stop bead means allows the panels to be inserted far enough into said channels to cover the ends of the panels and allows the panels to move past the stop bead means and deeper into said channels upon thermal expansion of the panels to prevent buckling thereof.

12. A molding bracket according to claim 11, wherein said flanges are closer together at said openings to said channels than at said division bar and two corresponding flanges in each said pair are normal to said division bar and present a flat surface at their exterior.

13. A molding bracket according to claim 12, wherein said stop bead means comprises a bead extending longitudinally of each of said corresponding flange.

14. A molding bracket according to claim 13, wherein said division bar, said flanges and said beads are integral with each other.

15. A molding bracket according to claim 14, wherein the bracket is made of polyvinyl chloride.

* * * * *